United States Patent [19]

Kitaoka

[11] Patent Number: 4,575,732

[45] Date of Patent: Mar. 11, 1986

[54] THERMAL PRINTER

[75] Inventor: Takashi Kitaoka, Ohtsu, Japan

[73] Assignee: Kabushiki Kaisha Ishida Koki Seisakusho, Kyoto, Japan

[21] Appl. No.: 655,570

[22] Filed: Sep. 28, 1984

[30] Foreign Application Priority Data

Sep. 30, 1983 [JP] Japan ..... 58-182575

[51] Int. Cl.[4] ..... B41J 3/20

[52] U.S. Cl. ..... 346/76 PH; 400/120; 219/216

[58] Field of Search ..... 346/76 PH, 76 R, 154; 400/120; 219/216 PH; 358/296–298; 364/518, 519

[56] References Cited

U.S. PATENT DOCUMENTS 4,369,452 1/1983 Anno et al. ..... 346/76 PH
4,475,114 10/1984 Koyama et al. ..... 358/296
4,491,853 1/1985 Hayashi et al. ..... 358/296
4,492,482 1/1985 Eguchi et al. ..... 400/120

FOREIGN PATENT DOCUMENTS 3302388 1/1983 Fed. Rep. of Germany .
1546289 5/1979 United Kingdom .
2087116 5/1982 United Kingdom .

*Primary Examiner*—E. A. Goldberg
*Assistant Examiner*—A. Evans
*Attorney, Agent, or Firm*—Staas & Halsey

[57] ABSTRACT

A printer having a circuit for controlling a heating head is arranged so that the heating head is divided into first and second heating element groups. When a printer control unit provides one line of print data, a first portion of the data is printed by the first heating element group during the first half of a printing cycle by supplying power solely to the first heating element group, and a second portion of the data is printed during the second half of the printing cycle by supplying power solely to the second heating element group.

2 Claims, 4 Drawing Figures

THERMAL PRINTER

BACKGROUND OF THE INVENTION

This invention relates to a printer having a heating head control circuit for driving a heating head which produces a thermosensitive recording on a thermosensitive recording medium. More specifically, the invention relates to a printer in which the heating head is divided into two side-by-side groups of heating elements which are energized and cooled in alternating fashion to make possible a reduction in the capacity of the heating head power supply.

A heating head is utilized to thermally color a thermosensitive recording medium such as thermosensitive paper, and forms desired patterns on the medium by means of the heat generated by the heating head. FIG. 1 illustrates an example of a circuit for controlling a heating head of this kind. The heating head 6' is equipped with heating elements $6_1'$ through $6_n'$ arrayed in a single row or in zig-zag fashion on the reverse side of a substrate. In response to a command from a control unit 1' constituted by a microcomputer or the like, a drive current from a power supply 5' is selectively applied to those of the heating elements $6_1'$ through $6_n'$ that correspond to the data to printed, whereby these heating elements are caused to emit heat and subject a thermosensitive paper to thermal energy in a dot-like pattern. The thermosensitive paper is thus caused to change color to form visible dots corresponding to the data. This recording process is performed across each line of the thermosensitive paper in line-by-line fashion. Specifically, after one line of data is recorded on the paper, the power supply 5' again supplies the drive current to those heating elements corresponding to the next line of data, and rollers feed the paper by one line so that the energized heating elements record the data on the next line.

The manner in which the energization of the heating head is controlled will now be described in greater detail. The control unit 1', assumed here to be composed of a microcomputer, supplies a shift register 2' with one line of print data PRD' in the form of a binary serial of "1"s and "0"s. The shift register 2', which successively shifts the print data PRD' in accordance with a shift clock, is adapted to store one line of the print data. The control unit 1' then produces a print enable signal PRE' and applies the signal to AND gates $3_1'$ through $3_n'$, thereby opening the gates so that the print data PRD' stored in the shift register 2' may be applied as parallel data to respective switching transistors $4_1'$ through $4_n'$. When the transistors $4_1'$ through $4_n'$ are turned on, the respective heating elements $6_1'$ through $6_n'$, connected in series with the transistors, are supplied with current from the power supply 5' and, hence, emit heat. Thus, the energized heating elements are selected in accordance with the print data PRD' received from the control unit 1' so that the heating head 6' records dots on the recording paper in a pattern decided by the selected heating elements.

Thus, in controlling the current feed to and the heating of the heating head in the conventional arrangement described above, all of the heating elements corresponding to one line of print data PRD are supplied en masse with current from the power supply 5 and, hence, emit heat simultaneously. Then, after a prescribed cooling period, heating elements corresponding to the next line of print data PRD are again selected and heated. According to this process, the recording of dots on the recording paper is performed by repeating a heating ($H_B$) and cooling (C) cycle, shown by (9) in FIG. 3. It is therefore required that the power capacity of the power supply 5' be great enough to simultaneously energize all of the heating elements $6_1' \ldots 6_n'$, and the power supply unit must be large in size. In addition, since the foregoing conventional arrangement relies upon repetition of a heating and cooling cycle, the power supply is idle during the cooling intervals, and the printer therefore, does not operate in an efficient manner.

SUMMARY OF THE INVENTION

An object of the present invention is to provide a printer having a heating head control circuit which makes it possible to reduce the capacity of a power supply for supplying the heating head with heating power, and to raise the efficiency at which the power supply is utilized.

According to the present invention, the foregoing object is attained by providing a printer having a printing head equipped with a plurality of heating elements divided into first and second groups, a power supply for supplying the heating elements with heating power so that the heating head may subject a thermosensitive recording medium to thermal energy to record data on the medium, and control means which, when one line of print data is provided by a control unit, is operable to supply power solely to the first group of the heating elements during the first half of a printing cycle and solely to the second group of the heating elements during the second half of the printing cycle.

The control unit includes means for delivering one line of print data to shift registers on the condition that a printing mode has been set and a signal is provided by a flip-flop, means for delivering a latch pulse to latch circuits which are connected to corresponding ones of the shift registers, when the next signal is provided by the flip-flop, means for setting a print enable signal to a high logic level print enable signal and for applying the high logic level to logic circuitry to control heating element energization, and means operable at the end of print data processing to reset the print enable signal to a low logic level and apply the low logic level print enable signal to logic circuitry.

Thus, according to the present invention, control for supplying the heating head with heating power is exercised by dividing a single line printing cycle into first and second portions, supplying power solely to the first group of heating elements in the first portion of the printing cycle, and supplying power solely to the second group of heating elements and cooling the first group of heating elements in the second portion of the printing cycle. Since the first and second groups of heating elements are heated and cooled in alternating fashion, the power supply which provides the heating power can be reduced in capacity and the efficiency at which the equipment is utilized can be raised. The printer using the foregoing heating head is simple in construction, low in cost and capable of being made small in size and therefore, is ideal for use as, e.g., a label printer of the type that prints price lables.

Other features and advantages of the present invention will be apparent from the following description taken in conjunction with the accompanying drawings.

DESCRIPTION OF THE PREFERRED EMBODIMENT

Figure 1:
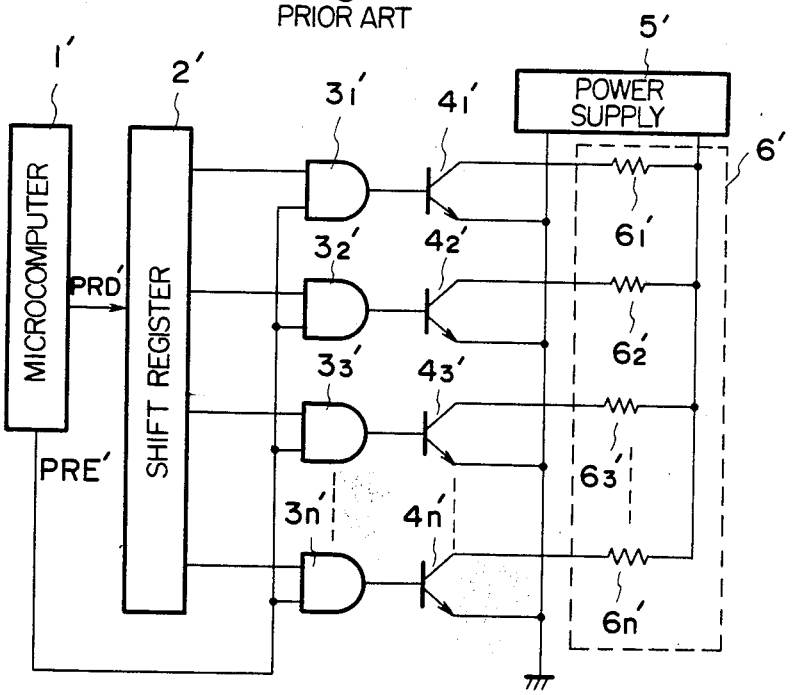
Fig. 1 PRIOR ART
FIG. 1 is a circuit diagram showing a circuit for controlling a conventional heating head.
Figure 2:
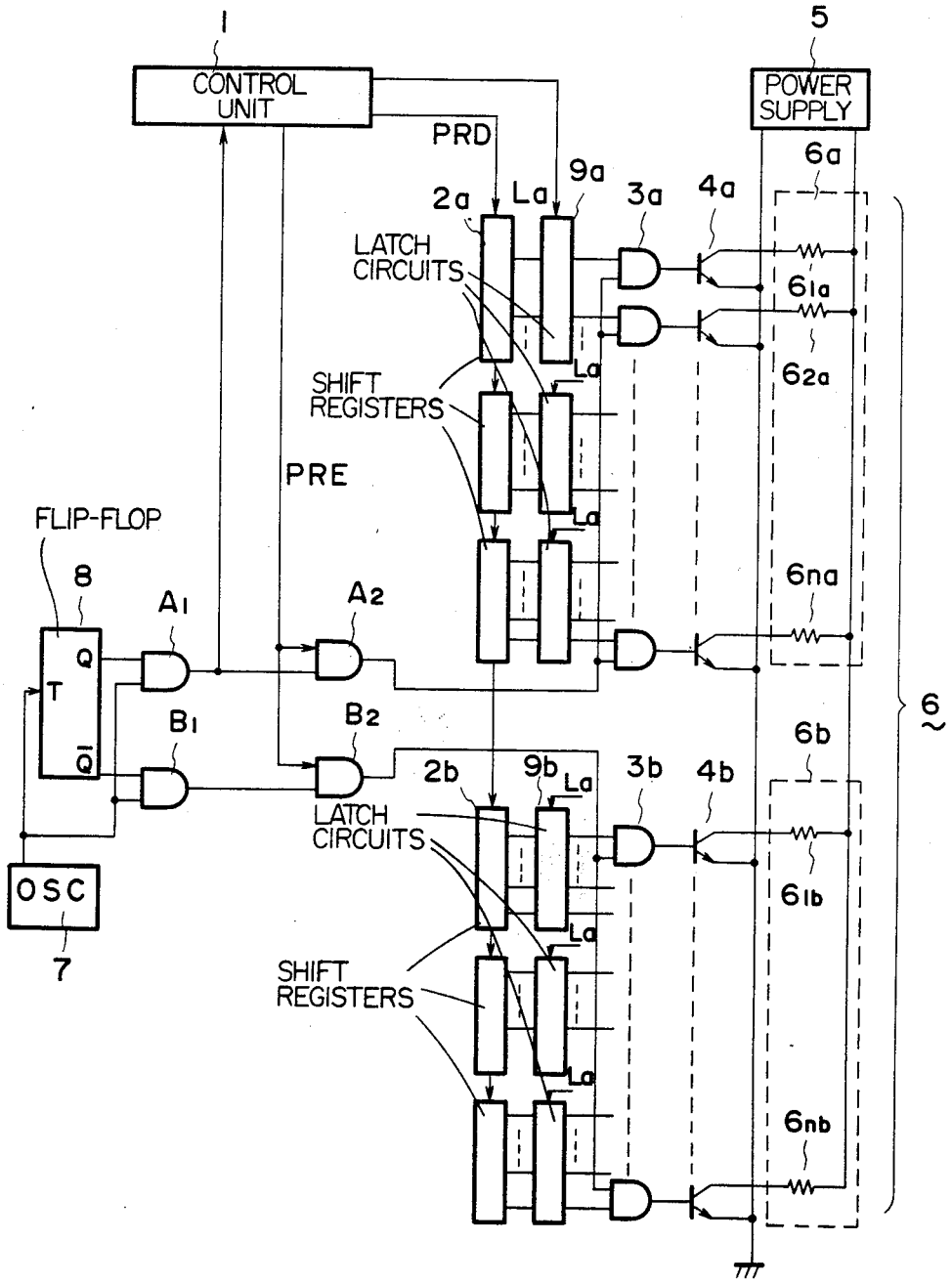
FIG. 2 is a block diagram illustrating an embodiment of a circuit for controlling a heating head in a printer according to the present invention.

FIG. 2 illustrates an embodiment of the present invention, including a heating head 6 having first and second (i.e., right and left) heating element groups 6*a*, 6*b*, respectively, arranged side by side with respect to one line of print processing space. Each of the heating element groups 6*a*, 6*b* is composed of a plurality of heating elements, $6_{1a}$–$6_{na}$ and $6_{1b}$–$6_{nb}$, respectively. The heating element groups 6*a*, 6*b* are alternatingly supplied with power from a power supply 5 in response to a control signal from a control unit 1, described below. An oscillator 7 produces pulses which are applied to the T terminal of a flip-flop 8 and to AND gates $A_1$, $B_1$. When a pulse from the Q terminal of the flip-flop 8 is applied to the AND gate $A_1$, the latter opens to deliver an oscillator pulse to an AND gate $A_2$ and to the control unit 1, which is constituted by a microcomputer or the like. Upon receiving the pulse from the AND gate $A_1$, the control unit 1 continuously applies one line of print data PRD to shift registers 2*a*, 2*b*. When the transmission of the print data is completed, the control unit 1 proceeds to apply a latch signal La to the latch circuits 9*a*, 9*b*. The control unit 1 subsequently sets a print enable signal PRE to logic "1" and applies the "1" logic signal to one input terminal of the AND gate $A_2$ and to one input terminal of an AND gate $B_2$. Since the AND gate $A_1$ is open in response to the output pulse from the terminal Q of flip-flop 8 and the high-level print enable signal PRE is applied to the AND gate $A_2$, the latter opens to supply one input terminal of each of the AND gates 3*a* with a high-level signal constituted by the pulse formed by the oscillator 7. As a result, the AND gates 3*a* open and enable the output signals from the latch circuits 9*a* to activate the bases of respective control transistors 4*a*. These in turn allow power from the power supply 5 to be supplied to the first (right) heating element group 6*a*. When the flip-flop 8 changes state owing to a pulse produced by the oscillator 7, a high-level pulse emerges from the terminal $\overline{Q}$ thereof. When this occurs, the AND gates $B_1$, $B_2$ and AND gates $3_b$ open to activate the bases of control transistors 4*b*, thereby allowing power from the power supply 5 to be delivered to the second (left) heating element group 6*b*. Thus, the first and second heating element groups 6*a*, 6*b* are alternately energized by the power supply in accordance with the oscillatory signal from the oscillator 7 to perform one line of dot printing. When a predetermined number of lines have been printed in this manner to complete the printing of the desired data, the control unit 1 resets the printing enable signal PRE to the logic "0" and applies the signal to the AND gates $A_2$, $B_2$.

Figure 3:
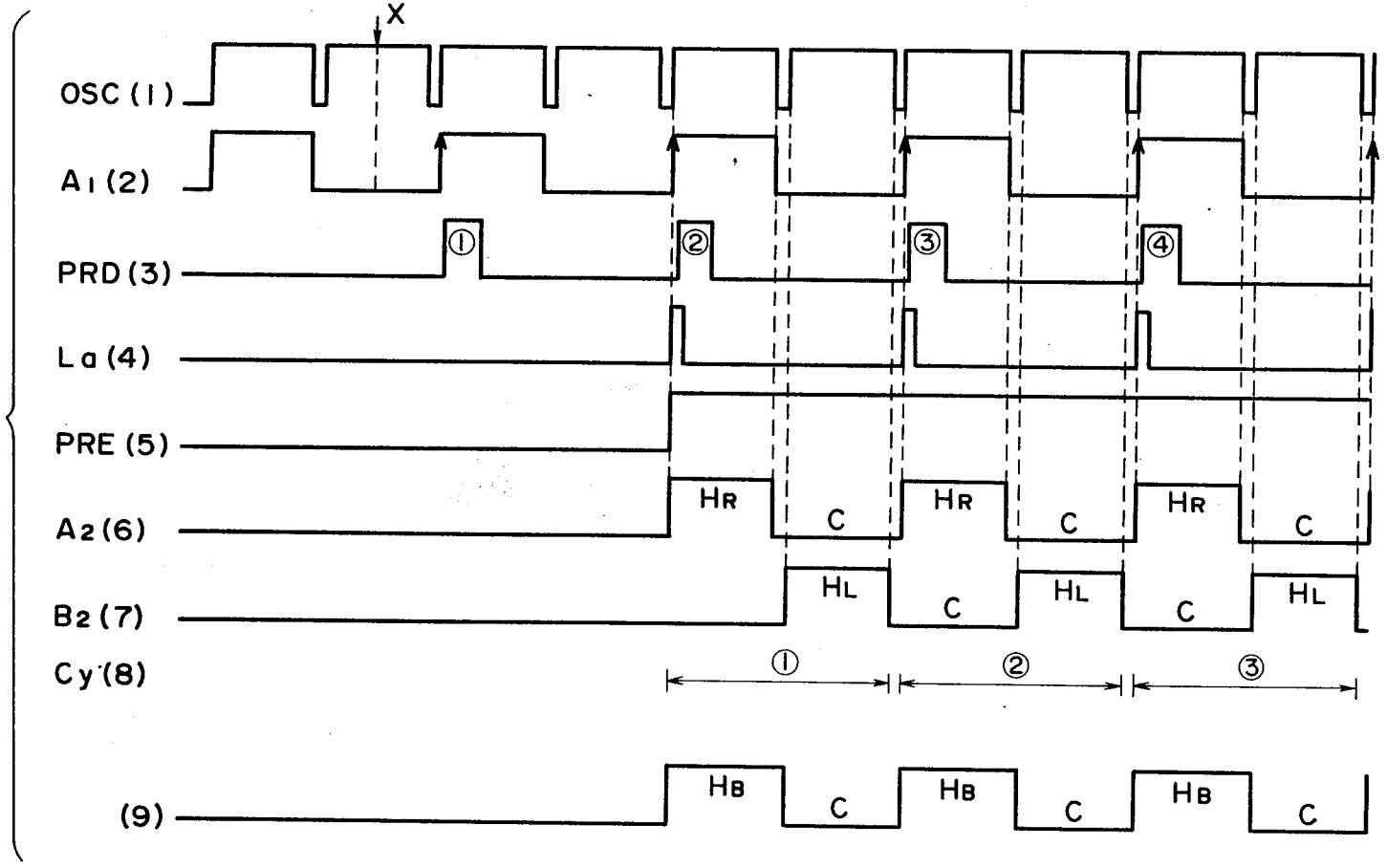
FIG. 3 is a time chart for comparing the operation of the control circuit in the printer of the present invention with the operation of the conventional control circuit.

Reference will be made to FIG. 3 for a more detailed description of the operation of the heating head control circuitry according to the present invention. The oscillator 7 generates pulses OSC (1) at a predetermined timing. If we assume that a printing subroutine starts at a point X which coincides with one of the pulses OSC, the AND gate $A_1$ will supply the control unit 1 with output pulses having the waveform $A_1$ (2) owing to the action of the flip-flop 8, which is actuated by the pulses OSC (1) from the oscillator 7. Based on the output pulses $A_1$ (2) from the AND gate $A_1$, the control unit 1 delivers one line of print data PRD (3) to the shift registers 2*a*, 2*b*. Pulses ① through ④ of the print data PRD (3) correspond to respective one-line printing cycles Cy (8). In response to the leading edge of the next pulse of the signal $A_1$ (2) from the AND gate $A_1$, the control unit 1 issues a latch pulse $L_a$ (4) so that the latch circuits 9*a*, 9*b* latch the line of print data PRD (2) initially delivered by the control unit 1. At the same time, the control unit 1 applies the print enable signal PRC (5) to the AND gates $A_2$, $B_2$. As a result, as indicated by $A_2$ (6), the first (right) heating element group 6*a* enters a heating cycle $H_R$ in the first half of the printing cycle, and enters a cooling cycle C in the second half of the printing cycle owing to a change in state of the flip-flop 8. Meanwhile, as indicated by $B_2$ (7), the second (left) heating element group 6*b* enters a cooling cycle C in the first half of the printing cycle, and enters a heating cycle HL in the second half of the printing cycle.

Figure 4:
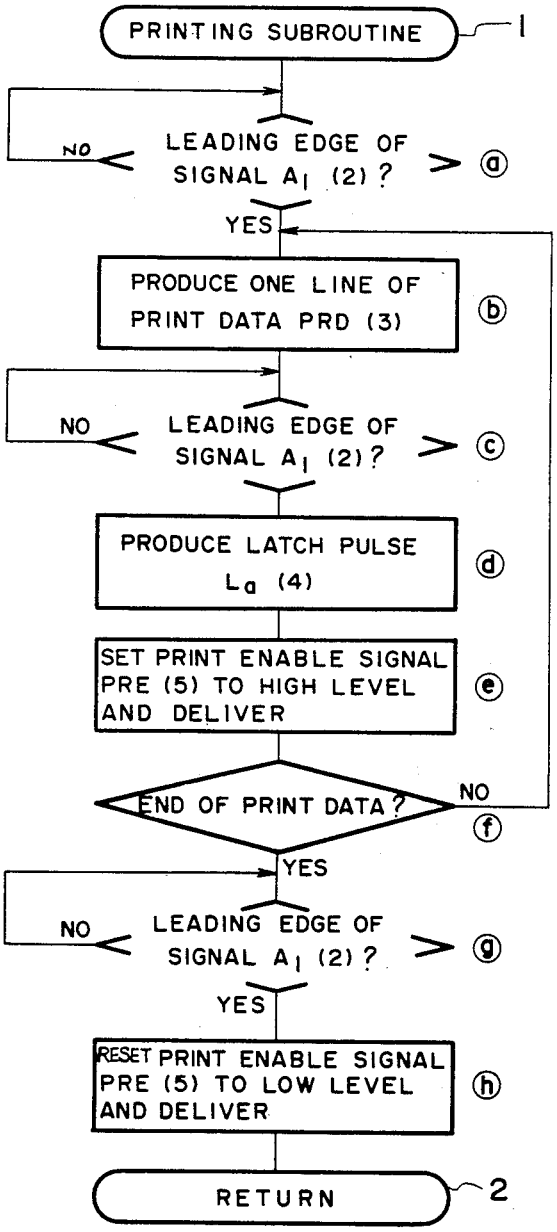
FIG. 4 is a flowchart illustrating the operation of a printer control circuit according to the present invention.

The operation of the control circuitry which performs the above-described control will now be clarified further with reference to the flowchart of FIG. 4.

When a printing subroutine starts, the control unit 1 examines the output signal $A_1$ (2) of the AND gate $A_1$ for a leading edge (step ⓐ). If a leading edge of the output signal $A_1$ (2) is sensed, the control unit 1 applies one line of print data PRD to the registers 2*a*, 2*b* (step ⓑ). The control unit 1 then checks the next output signal $A_1$ (2) from the AND gate $A_1$ for the leading edge thereof (step ⓒ). If the leading edge is sensed, then the control unit 1 applies the latch pulse $L_a$ (4) to the latch circuits 9*a*, 9*b* (step ⓓ) to latch the last-delivered line of print data PRD (3) in the latch circuits 9*a*, 9*b*. The control unit 1 then raises the print enable signal PRC (5) to the high level and applies it to the AND gates $A_2$, $B_2$ (step ⓔ). Next, the control unit 1 determines whether this is the end of print data (step ⓕ). If it is not, the program returns to step ⓑ and the control unit repeats the processing from steps ⓑ through ⓔ. During such processing, the first or right heating element group 6*a* of the heating head 6 is energized in the first half of each printing cycle, and the second or left heating group 6*b* is energized in the second half of each printing cycle, as described above. If the control unit 1 decides in step f that all print data has been delivered and read, the control unit examines the signal $A_1$ (2) for the leading edge thereof (step ⓖ). When the leading edge is sensed, the control unit resets the print enable signal PRE (5) to the low level and applies the signal to the AND gates $A_2$, $B_2$ (step ⓗ).

As many apparently widely different embodiments of the present invention can be made without departing from the spirit and scope thereof, it is to be understood that the invention is not limited to the specific embodiments thereof except as defined in the appended claims.

What we claim is:

1. A printer for printing on a recording medium by controlling the supply of electric power to a heating head, comprising:

a heating head equipped with first and second heating element groups each heating element group having a plurality of heating elements;

a control unit for producing print data to be printed by said heating head, a latch pulse and a print enable signal;

a plurality of shift registers, operatively connected to respective ones of said heating elements, for storing print data produced by said control unit;

a plurality of latch circuits, operatively connected to respective ones of said shift registers and responsive to the latch pulse, for latching the print data stored by said shift registers;

a plurality of switch elements operatively connected between respective ones of said latch circuits and said heating elements;

a flip-flop for alternately producing first and second signals;

logic circuitry operable when the print enable signal is produced, to apply, in response to the first signal from the flip-flop, output signals from the latch circuits corresponding to said first heating element group to switching elements, for driving said first heating element group, and to apply, in response to a second signal from the flip-flop, output signals from the latch circuits corresponding to said second heating element group to switching elements, for driving said second heating element group.

2. A printer according to claim 1, wherein said control unit comprises:

means for setting a printing mode;

means for delivering one line of print data to said shift registers when the printing mode has been set and the first signal is provided by said flip-flop;

means for delivering the latch pulse to said latch circuits in response to a subsequent output of the first signal by said flip-flop;

means for setting the print enable signal to a high logic level and for applying the resulting high-level print enable signal to said logic circuitry to control heating element energization; and means, operable at the end of print data processing, for resetting the high-level print enable signal to a low logic level and applying the resulting low-level print enable signal to said logic circuitry.

* * * * *